United States Patent [19]

Morton

[11] Patent Number: 5,035,343

[45] Date of Patent: Jul. 30, 1991

[54] EASY-OPEN AND RECLOSABLE CONTAINER

[75] Inventor: Jay Morton, Miami Beach, Fla.

[73] Assignees: The City of Hope, Duarte, Calif.; Lucille T. Morton, Miami Beach, Fla. ; a part interest

[21] Appl. No.: 451,461

[22] Filed: Dec. 13, 1989

[51] Int. Cl.[5] ..... B65D 17/32

[52] U.S. Cl. ..... 220/270; 220/243

[58] Field of Search ..... 220/270, 268, 269, 272, 220/273, 1 BC, 233, 243, 265, DIG. 13

[56] References Cited

U.S. PATENT DOCUMENTS

| | | | |
|---|---|---|---|
| 3,982,656 | 9/1976 | Kusmierski et al. | 220/243 X |
| 4,139,114 | 2/1979 | Long et al. | 220/23.4 |
| 4,234,099 | 11/1980 | Tarro | 220/269 |
| 4,356,929 | 11/1982 | Müller-Kühn et al. | 220/270 |
| 4,387,826 | 6/1983 | Heubl | 220/243 |
| 4,391,385 | 7/1983 | Rausing | 220/270 X |
| 4,429,804 | 2/1984 | Pease | 220/243 X |
| 4,580,692 | 4/1986 | La Barge et al. | 220/270 X |
| 4,678,096 | 7/1987 | La Barge et al. | 220/273 |

*Primary Examiner*—Stephen Marcus
*Assistant Examiner*—Vanessa M. Roberts
*Attorney, Agent, or Firm*—Irell & Manella

[57] ABSTRACT

An easy-open and reclosable container has a non-circular scored portion on the top lid and an opening and resealing device pivotally fastened on the scored portion for selectably separating it from the top lid to provide an aperture, and selectably resealing the aperture by putting the separated portion back into the aperture and rotating it so as to lock it under the inner surface of the top lid. The opening and resealing device has a compression sealing member for resealing the aperture while the scored portion is locked. As an alternative, the easy-open and reclosable container can utilize an openable and reclosable device which includes a bottom flange member fastened on the top lid having a flange rim extending through an opening on the top lid, a closure member hingedly connected to the rim in part and having a channel complementary in shape with the flange rim, and a tension controlling member hingedly connected to the closure member and separable engaged with a rivet on the top lid for selectably releasing the pulling force on the closure member to allow it to open and selectably re-exerting the pulling force on the closure member to reclose the container. The present invention further provides a triangular cylindrical beverage container which can save storage space.

13 Claims, 3 Drawing Sheets

FIG. 6.
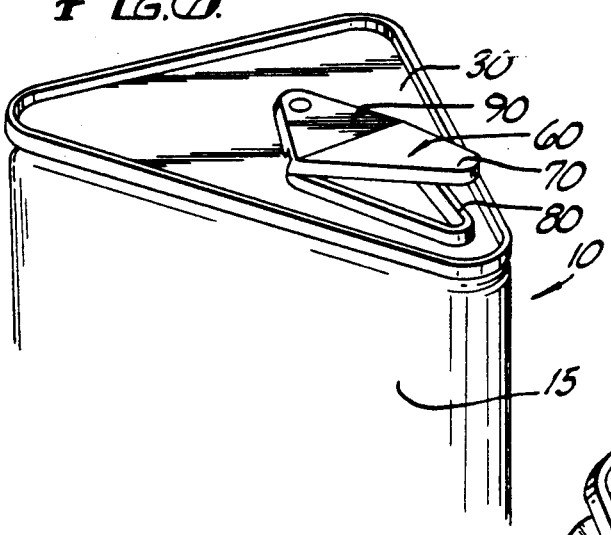
FIG. 7.
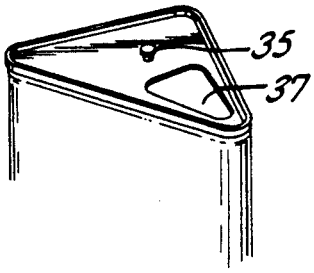
FIG. 9.
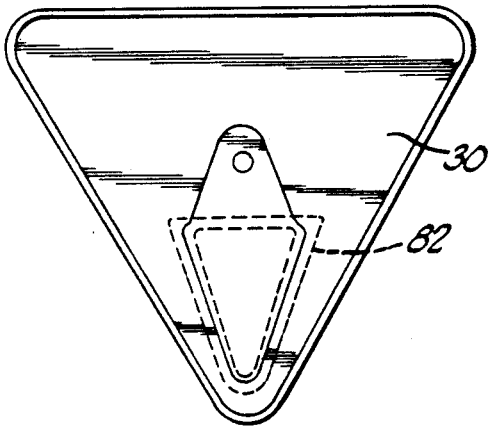
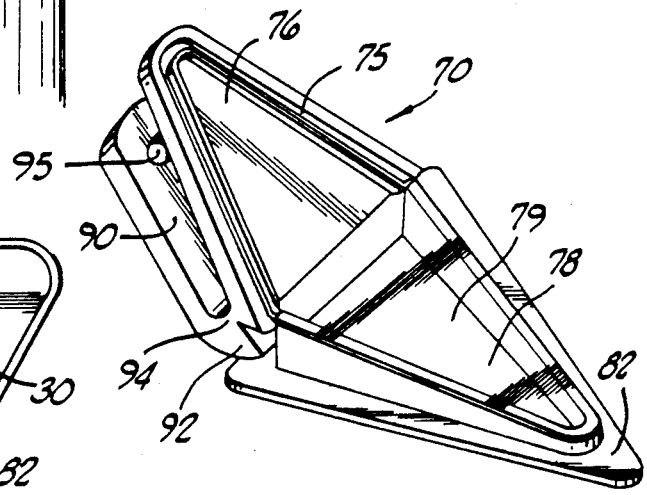
FIG. 8.
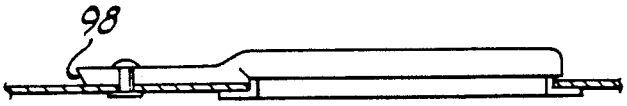
FIG. 10A.
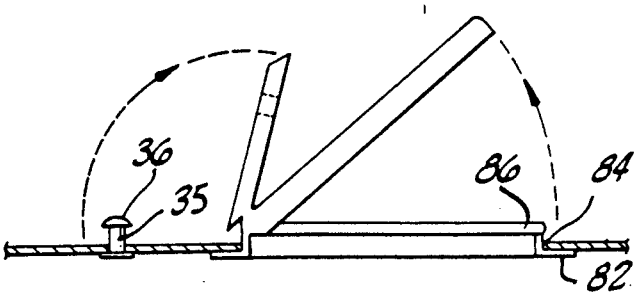
FIG. 10B.

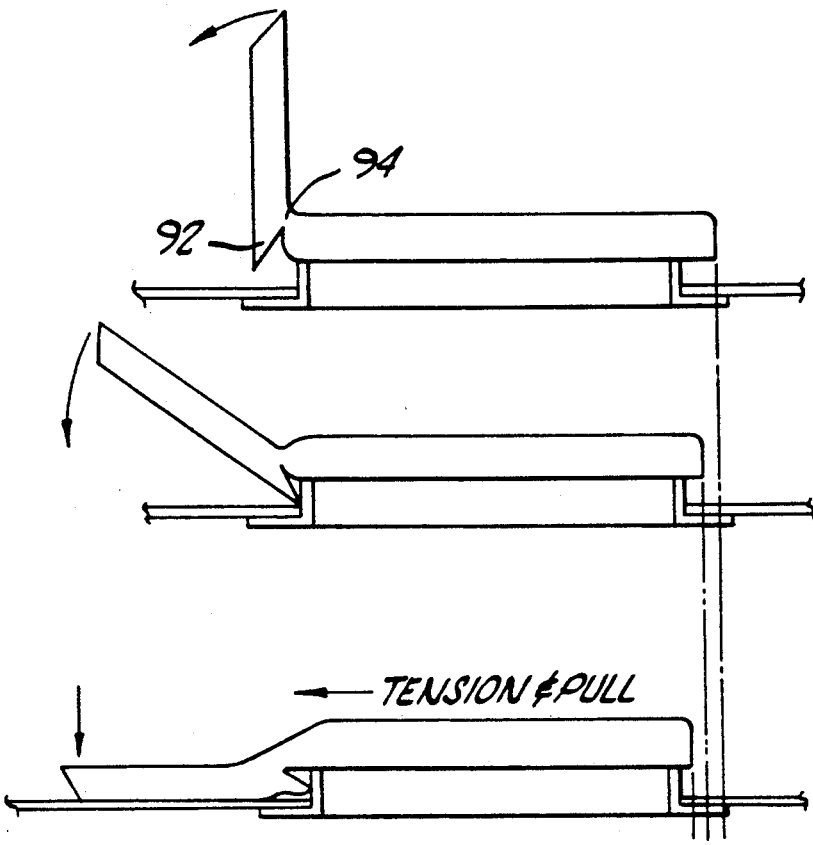
FIG. 11A.
FIG. 11B.
FIG. 11C.
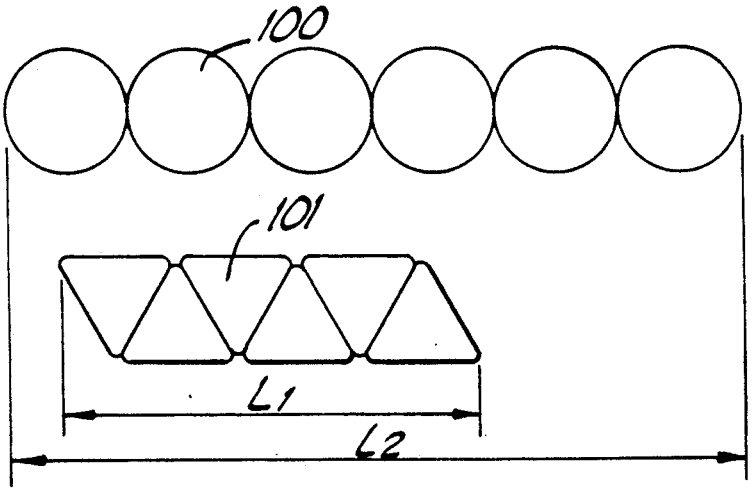
FIG. 12A.
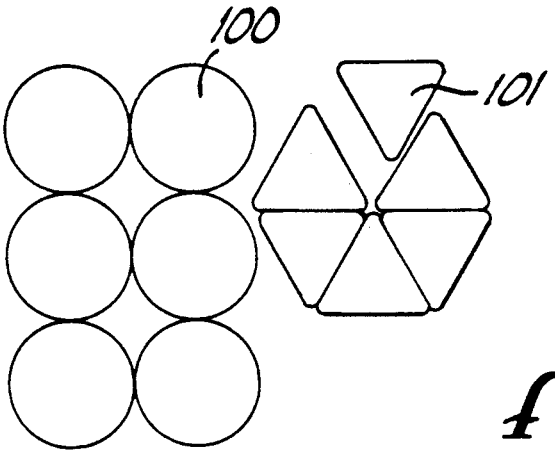
FIG. 12B.

EASY-OPEN AND RECLOSABLE CONTAINER

BACKGROUND OF THE INVENTION

The present invention relates to an easy-open and reclosable container, especially to two types of easy-open and reclosable devices for a beverage container, and also relates to a triangular beverage container.

Beverage containers usually have a lifting tab attached to the top lid by means of a rivet for selectively depressing a scored portion on top of the top lid into the interior of the container to provide an aperture by pulling the lifting tab upwardly. The lifting tab cannot normally be used to reseal the aperture. After an unreclosable beverage container is opened any portion of the beverage not immediately consumed is usually discarded, since it is not practical to transport an unsealed container, and any beverage in the container has a tendency to "go flat" if stored due to the escape of dissolved gases.

In recent years, some reclosable mechanisms attached to a container have been suggested in the prior art. These include U.S. Pat. No. 4,442,950 issued on Apr. 17, 1984 to Thomas P. Wilson, U.S. Pat. No. 4,463,866 issued on Aug. 7, 1984 to George Mandel, U.S. Pat. No. 3,880,319 issued on Apr. 29, 1975 to Robert A. Wells et al, U.S. Pat. No. 4,673,099 issued on Jan. 16, 1987 to Robert A. Wells, U.S. Pat. No. 4,232,797 issued on Nov. 11, 1980 to Nelson J. Waterbury, U.S. Pat. No. 4,582,216 issued on Apr. 15, 1986 to Alan E. Byrd, U.S. Pat. No. 4,562,936 issued on Jan. 7, 1986 to Joseph F. Deflander, U.S. Pat. No. 2,546,561 issued on Mar. 27, 1951 to Miles 0. Polson et al and U.S. Pat. No. 4,681,238 issued on July 21, 1987 to Ruben G. Sanchez.

The Wilson patent, Mandel patent and Wells U.S. Pat. No. 4,673,099 disclose a type of reclosable container having a scored portion on the container top lid and a removable lever member pivotally mounted on the top lid by a pivot rivet. Upon raising the lever member, the scored portion will be broken downwardly by the end of the lever member to form an opening. The lever member has a depending plug with a layer of resilient material on it for resealing the opening. In some cases, there is provided a stopper portion on the depending plug. However, there are limitations associated with a depending plug configuration. For example, this kind of reclosure is easily inadvertently reopened when bumped or when the container falls from a table. If a stopper portion is provided it is hard to add the resilient material onto it during manufacture due to the shape of the depending plug. Further, the lever member needs to sit in a protective recess for protection of it from contamination prior to use. As a result, applications of depending plug configurations are limited.

The Wells et al U.S. Pat. No. 3,880,319 teaches a similar reclosable container including a scored portion on the container top lid, and a closure member movably attached on the top lid and having a depending plug. The depending plug has a severing edge used to break the scored portion to provide an opening. To reclose the container, the depending plug can be moved into the opening to provide a friction engagement between the depending side of the depending plug and the adjacent side of the opening. This closure member has similar limitations to the above discussed reclosure mechanisms.

The Waterbury patent and Byrd patent show another type of reclosable container having a plug member articulated on the container top lid which is not only used to initially seal an opening on the toplid, but is reinsertable into the opening to reclose the container. The plug member has a lift element integrally formed on the plug member used to open the container by pulling the member upwardly. The Waterbury patent further suggests that the plug member can be made of plastic material and shaped in complementary fashion to the opening. This type of reclosable container still has the problem that the reclosed opening may be inadvertably reopened when bumped and the like. Moreover, if the plug member is made of plastic material and shaped in complementary fashion to the opening, the plastic lift element may sometimes have not enough tensile strength to open the sealed plug.

Sanchez discloses a resealable container comprising a scored portion on the container top lid and a rotatable tab member pivotally connected by a rivet assembly to a sealing member and resealing lobe with a resilient sealing layer attached on the inner surface of the container top lid. The rotatable tab member can be raised to depress the scored portion and the sealing member into the interior of the container to expose an opening. The resealing lobe is integral with the sealing member, and upon rotation of the tab member can be positioned so as to reseal the opening. As there is relatively large friction during the rotation operation, the rivet assembly has an inner rivet head and an outer sleeve portion. In this construction, all the sealing or resealing elements are set in the container. This type of resealable mechanism is very complicated and hence expensive to manufacture. Additionally, the material used to make the sealing member and resealing lobe must be carefully chosen because these elements are positioned in the container where they will be in contact with its contents.

Commercially available beverage containers today are normally made in round, cylindrical shapes. However, the round beverage containers waste a lot of space in supermarket, storage and shipping areas. In addition, round containers easily roll when dropped and can be dangerous. This is not desirable, especially while in airplanes, trains, cruise ships, passenger buses, boats or cars.

U.S. Pat. No. 4,139,114 issued on Feb. 13, 1979 to Elizabeth T. Long et al for "Composite Container Having A Plurality Of Removable Sections" discloses a composite container with at least three separable individual compartments. In one embodiment, the composite compartmented container is divided into right-triangular separate compartments joined together by solder globules to form an overall round configuration.

Another U.S. patent for "Container" in U.S. Pat. No. 3,880,342 issued on Apr. 29, 1975 to Stephen H. Longo, Jr., suggests forming multiple attached triangular containers for receiving a product by using a unitary blank having foldable panels and end panels formed from the same blank.

The present invention overcomes the limitations or disadvantages in the previous reclosable containers and the round containers by providing two types of new easy-open and reclosable containers and a triangular beverage container.

OBJECTIVE OF THE INVENTION

It is an objective of the present invention to provide a novel easy-open and resealable container in which resealing is accomplished in a mechanically secure manner.

It is another objective of the present invention to provide a novel easy-open and resealable beverage container in which resealing in an air tight manner is accomplished.

It is still another object of the present invention to provide a resealable closure device which can be used in combination with a scored portion on the container top lid to reseal the container.

It is a further object of the present invention to provide a resealable closure device which can be made of plastic material and fixed on a container to seal and reseal the container.

It is still a further object of the present invention to provide a triangular cross section beverage container.

It is still a further object of the present invention to provide an easy-open and resealable triangular cross section container.

These and still further objects and advantages will become apparent hereinafter.

SUMMARY OF THE INVENTION

The present invention provides an easy-open and reclosable container comprising a non-circular opening portion severable from the container top lid to provide an aperture and an opening and resealing assembly fastened to the opening portion by a pivot. The opening and resealing assembly includes a grip hinged to the pivot and being adapted to move the opening portion vertically and rotate it horizontally, and a compression seal member dimensioned to cover the aperture and disposed between the grip and the opening portion. To open the container, the grip is pulled upwardly to tear and separate the pre-scored opening portion from the top lid. To reseal the container, the opening portion is pushed down into the aperture and rotated so that the opening portion is locked beneath the top lid and the aperture is resealed by the compression seal member due to a downward force.

In another preferred embodiment of the present invention, the easy open and reclosable container comprises a container top lid having an opening, and an openable and reclosable assembly which includes a bottom flange portion mounted on the inner surface of the top lid and having an elevated rim extending upwardly through the opening defining an aperture, a closure portion with a channel for cooperative and sealing engagement with said rim, and a tension controlling portion having a hole at one end separably engaged with an elevated locking nipple fixed on the top lid, the opposite end of the tension controlling portion joined to the closure portion by a deformable hinge portion which has a locking lip to exert a tension on the closure portion while the hole sits on the locking nipple. To open the closure portion, the tension controlling portion is raised to release the tension.

The present invention further provides a triangular cylindrical beverage container which has a triangular cross section.

BRIEF DESCRIPTION OF THE DRAWINGS

FIG. 6 is a perspective view of another preferred embodiment of an easy-open and reclosable container of the present invention.

FIG. 7 is a perspective view of the container top lid having an aperture shown by FIG. 6.

FIG. 8 is a perspective view of the openable and reclosable assembly used on the container shown in FIG. 6.

FIG. 9 is a top plan view of the openable and reclosable assembly shown in FIG. 6.

FIG. 10A and 10B show the opening operation of the openable and reclosable assembly shown in FIG. 6.

FIGS. 11A, 11B and 11C show the resealing operation of the operable and reclosable assembly shown in FIG. 6.

FIG. 12A, and 12B show the advantages of the triangular cylindrical beverage container of the present invention in a space-saving aspect.

DETAILED DESCRIPTION OF THE INVENTION

One of the preferred embodiments of the easy open and reclosable container of the present invention generally indicated as 10, is shown in FIGS. 1–5. The container 10 is suitable for holding beverage, but it can also be used to contain other material, such as oil, powder products, candy etc. In the exemplary embodiment shown in FIG. 1, container 10 has a triangular cross-section with rounded corners. Container 10 generally comprises a body portion (not shown), a top lid 20 joined to the upper end of the body portion, a bottom end panel (either separate or integral to the body portion, not shown), and an opening and resealing assembly 50.

Figure 1:
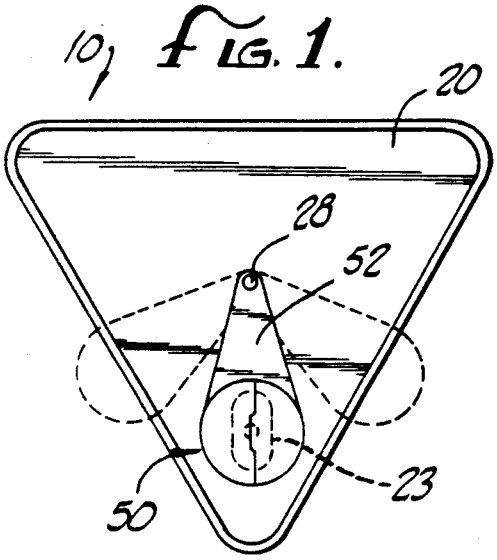
FIG. 1 is a plan view of a preferred embodiment of an easy open and resealable container of the present invention having a triangular cylindrical container body.

The top lid 20 includes a selectably separable oval-shaped opening portion 25 of predetermined structural weakness which is defined by a score line 23 stamped into the top lid 20 (shown by a dash line in FIG. 1). The opening and resealing assembly 50 comprises a grip 58 pivotally connected to the opening portion 25 by a central pivot 45 (shown by a dash line) for controlling opening and resealing of the container. The opening portion 25 can be moved vertically and rotated horizontally by the grip 58 in opening and resealing operations. The grip 58 is hingedly connected onto the pivot 45 by a central crimp configuration 48. The opening and resealing assembly 50 is cantilevered on an arm 52 which is attached to the top lid 20 by a rivet 28 integral with the top lid 20 so that the assembly 50 along with the attached opening portion 25 can be displaced after the opening portion 25 is separated from the top lid 20.

Figure 2:
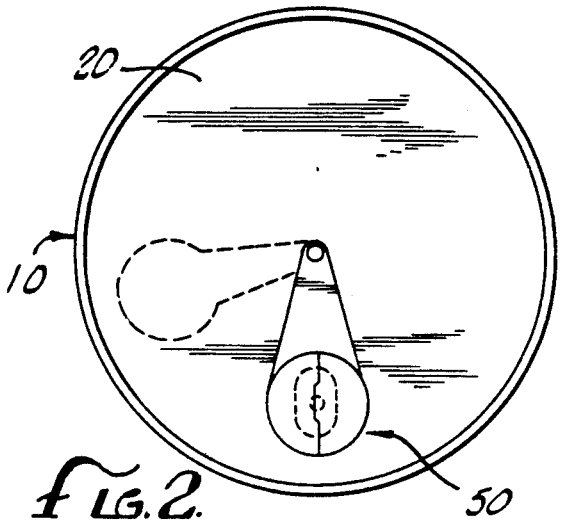
FIG. 2 is a plan view of an easy-open and resealable container of the present invention having a round cylindrical container body.

FIG. 2 shows an easy-open and reclosable container of the present invention which has a conventional round cylindrical container body portion. However, container 10 of the present invention may take on other cross-sectional configurations such as oval, rectangular or polygonal.

Figure 3:
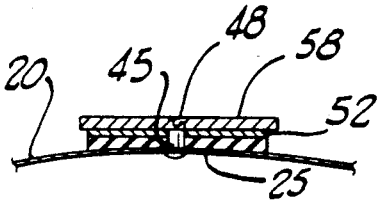
FIG. 3 is an enlarged cross-sectional view of the opening and resealing assembly of the present invention connected to the opening portion on the top lid.

Referring now to FIG. 3, there is shown an enlarged cross-sectional view of the opening and resealing assembly. Besides the grip 58, the assembly 50 further includes a compression seal member 54 fastened on the arm 52, both of which are disposed and restrained between the grip 58 and the opening portion 25 by the central pivot 45, and dimensioned to overlie the opening portion 25 for resealing the aperture provided by the opening portion after it is separated from the top lid 20. In this embodiment, the seal member 54 is shaped in a round disc configuration, but other shapes can be chosen as long as the seal member 54 can cover the aperture. Since the assembly 50 is integrally attached to the arm 52, the assembly 50 can be displaced by displacement of the arm 52. The compression seal member 54 is preferably made of resilient material, such as plastic material, rubber or the like.

Figure 4A:
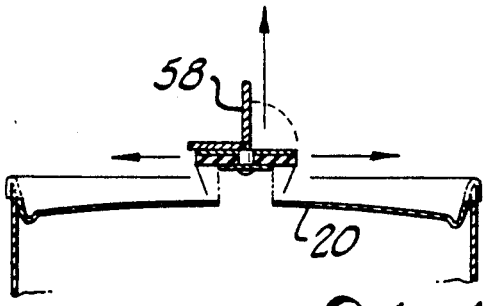
FIG. 4A is a cross-sectional view of the opening and resealing assembly along with the opening portion in FIG. 1 or FIG. 2 while the opening portion is separated from the top lid.

Turning now to the operation of the embodiment described, in opening operations as shown by FIG. 4A the grip 58 is elevated to a vertical position and pulled to fracture and separate the scored opening portion to provide an aperture. Displacing the opening and resealing assembly 50 then provides access to the aperture.

Figure 4B:
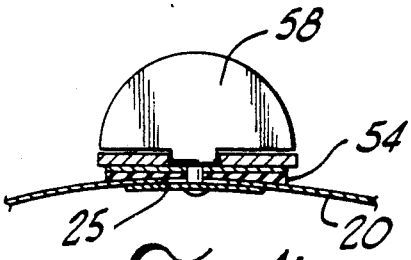
FIG. 4B is a cross-sectional view of the opening and resealing assembly along with the opening portion while the opening portion is locked under the inner surface of the top lid and the opened aperture is resealed.

To reclose the container, the opening and resealing assembly 50 is rotated back to its original position, depressed to lower attached opening portion 25 below the container top lid surface, and then the non-circular opening portion 25 is rotated beneath the container top lid by rotating the grip 58 at an angle such as 90° to lock the assembly 50 in place. Upon being locked, the opening portion 25 will supply a downward pulling force to the compression seal member 54 through the central pivot 45 to reseal the aperture, as shown by FIG. 4B.

Figure 5:
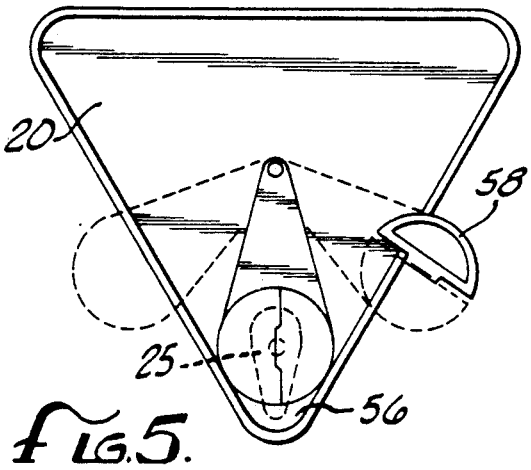
FIG. 5 shows an alternate design of the opening and resealing assembly and the opening portion shown by FIG. 1 or FIG. 2.

FIG. 5 shows an alternate design of the opening and resealing assembly 50 and the opening portion 25. In this embodiment, the opening portion 25, the compression seal member 54 and the holder member 56 are in a "V" shape or triangular shape. The grip 58 is configured in a finger ring shape convenient for fingers to operate.

FIG. 6 through FIG. 10 show another preferred embodiment of an easy-open and reclosable container of the present invention. The container 10 includes a triangular cylindrical body portion 15, a bottom end panel (not shown) and a top lid 30. However, the container body portion 15 need not necessarily be a triangular shape. It may be of the conventional round shape or any other shape. The container can be used as a beverage container or used to contain other material or liquids such as motor oil, lubrication oils, etc. The container top lid 30 has a triangular or V-shaped opening 37 (shown in FIG. 7).

The container further includes an openable and reclosable assembly 60 comprised of a bottom flange member 80, a closure member 70 and a tension controlling member 90. The assembly 60 is preferably made of plastic material, although other materials would be suitable. The bottom flange member 80 is provided with a bottom flange 82 having a similar shape as the opening 37 but in a larger size, and which is fixed on the inner surface of the top lid 30. A flange rim 84 formed integrally with the bottom flange 82 and extends upwardly through the opening 37 of the top lid. The flange rim 84 is configured to have a flange beam portion 86 at the upper end. An aperture 78 is defined by the inner side of the flange rim 84. The closure member 70 is hingedly and integrally connected to the flange rim 84 in part and has a channel 75 which is complementary in shape with the flange rim 84 for cooperative and sealing engagement with it. The closure member can be provided with a recess 76 facing the aperture 78. As an alternative, the closure member 70 may have a downward depending edge, instead of a channel, the inner side of which is complementary in shape with the outer side of the rim 84 for cooperative and sealing engagement. The tension controlling member 90 has a hole 95 at one end separably engaged with a rivet 35 fastened on the top lid 30. The rivet 35 may be formed with a cap portion 36 on its top to prevent undesired slipping off of the tension controlling member from the rivet 35. There is a finger holding portion 98 at this end to allow a person to lift the tension controlling member. The opposite end of the tension controlling member 90 is joined to the closure member 70 by a deformable hinge portion 94 and has a locking lip 92 with a tip.

In considering the operation of the embodiment, it is assumed that the tension controlling member 90 is initially locked on the rivet 35 and the closure member 70 seals the flange rim 84 due to the tension applied to the closure member as shown by FIG. 10A. When a person desires to open this container, he first pulls the tension controlling member 90 upwardly to let the locking lip 92 part from the flange rim so as to release the tension on the closure member 70. After the tension or pulling force applied on the closure member is released, the closure member can be lifted to provide an access to the aperture 78 as shown by FIG. 10B. To insure against the possible introduction of foreign substances or contaminants, a continuous, thin transparent safety film or foil 79, requiring user puncturing or peeling and removal, is adhered over the aperture 78 and the undersurface (76) conformity of closure member 70. To reclose the container, the closure member 70 is moved back to the original position with its channel 75 engaged with the flange beam 86, and then the tension controlling member 70 is pressed downwardly to let the rivet 35 engage the hole 95 to lock the member 70 again. During the locking operation, the tip of the locking lip 92 gradually engages or bites into the side wall of the flange rim 84 against the downward movement of the tension controlling member 70, so that the downward movement under the manually downward force results in a stretching deformation of the deformable hinge portion. This increasingly transfers a tension or pulling force to the closure member until the tension controlling member is locked on the rivet 35, as shown in FIG. 11A, 11B and 11C, wherein the dashed lines show the deformations of the closure member responsive to the pulling force during the locking operation. Once the locking operation is completed, the channel 75 of the closure member and the flange rim 84 are in sealing engagement again.

In accordance with another aspect of the present invention there is provided a triangular cylindrical beverage container comprising a triangular cylindrical body portion having a triangular cross-section, a bottom end panel and a top lid having marginal flanges which embrace the upper end of the triangular cylindrical body portion. The top lid has a scored portion which can be separated from the top lid to provide an opening by an opening device, such as a conventional pull tab hingedly mounted on the top lid by a rivet. Alternatively, the triangular beverage container may utilize a reclosable device attached on the top lid. The body portion and top lid have rounded corners. The triangular cross section of the container body portion is preferably an equilateral triangle.

The triangular beverage container of the present invention can offer a number of advantages over conventional round containers. First, there will be a significant amount of space savings on the supermarket shelf, in storage and shipping areas, and in the home refrigerator. FIG. 12A shows the relative shelf space occupied by the conventional round containers 100 and the equilateral triangular beverage containers 101 of the present invention for the same volume of contents. As can be seen in the drawing, the lateral storage space L1 necessary for the triangular containers 101 is significantly less than the lateral storage space L2 necessary for round containers 100. FIG. 12B is a packaging comparison between a six-pack of the conventional round containers and six-pack of the equilateral triangular containers of the present invention for the same volume of contents. It can be seen from the drawing that the triangular containers 101 fit together in a six pack arrangement with no wasted space, and occupy much less storage area than a six pack arrangement of round containers 100. Another advantage of the triangular beverage container of the present invention is that the triangular container would not roll when dropped, as in the case of round containers dropped in airplanes, in boats or in other vehicles, for examples. Moreover, a triangular can having an end with an aperture adjacent one of the can's "V-shaped" corners pours a liquid in a steadier stream than a round can because of the natural channeling effect of the "V-shaped" corners.

The triangular beverage container in accordance with the present invention can be made by any of the known two piece or three piece container manufacturing techniques, such as drawing and ironing the body and integral bottom.

What is claimed is:

1. An easy-open and reclosable container comprising:

a container body portion having a bottom end panel, a container top lid having a non-circular opening portion severable from said top lid to provide an aperture, an opening and resealing assembly fastened on said opening portion by a central pivot means and including a grip means hinged to said central pivot means and being adapted to move said opening portion vertically and rotate said opening portion horizontally about said central pivot means for respectively opening and locking the same, a compression seal means dimensioned to overlie said aperture and disposed between said grip means and said opening portion for resealing said aperture under a downward force, said opening and resealing assembly cantilevered on an arm extending from an integral rivet on said top lid for displacing said resealing assembly while said opening portion is separated from said top lid.

2. An easy-open and reclosable container claimed in claim 1, wherein said compression seal means includes a sealing member made of resilient material overlying said opening portion for resealing said aperture provided by said opening portion.

3. An easy-open and reclosable container claimed in claim 2, wherein said sealing member is attached on a holder element which is cantilevered on said arm for displacing said opening and resealing assembly along with said opening portion while said opening portion is separated from said top lid.

4. An easy-open and reclosable container claimed in claim 1 or 3, wherein said container body portion has a triangular cross section.

5. A unitary triangular beverage container comprising:

a container body portion having a triangular cross section, a container bottom panel connected to said body portion, top lid portion mounted on top of said body portion and having an opening portion severable from said top lid portion to provide an aperture, a tab means hingedly mounted on said top lid for controlling the movement of said opening portion.

6. A triangular beverage container claimed in claim 5, wherein said container body portion has three rounded corners.

7. A triangular beverage container claimed in claim 5 or 6, wherein said container body portion has an equilateral triangular cross section.

8. An easy-open and reclosable container comprising:

a container body portion having a bottom end panel, a container top lid having a non-circular opening portion separable from said top lid to provide an aperture, an opening and resealing assembly fastened on said opening portion by a central pivot means and including a grip means being adapted to move said opening portion vertically and rotate it horizontally about said central pivot means for opening and locking the same, and a compression seal means dimensioned to overlie said aperture and disposed between said grip means and said opening portion for air-tight resealing said aperture under a downward force.

9. An easy-open and reclosable container claimed in claim 8, wherein said compression seal means includes a sealing member made of resilient material overlying said opening portion for resealing the container.

10. An easy-open and reclosable container claimed in claim 9, wherein said sealing member is attached on a holder element which has a similar shape and size as said sealing member.

11. An easy-open and reclosable container claimed in claim 8 or 10, wherein said compression seal means is cantilevered on an arm extending from an integral rivet on said top lid for displacing said opening and resealing assembly along with said opening portion while said opening portion is separated from said top lid.

12. An easy-open and reclosable container claimed in claim 8, wherein said grip means is hingedly connected to said pivot means and is adapted to be operated by fingers to move and rotate said opening portion.

13. An easy-open and reclosable container claimed in claim 8, wherein said container body portion has a triangular cross section.

* * * * *